US007607703B2

(12) United States Patent
Cho

(10) Patent No.: US 7,607,703 B2
(45) Date of Patent: Oct. 27, 2009

(54) TRAY LATCHING DEVICE

(75) Inventor: Joung-Hwan Cho, Incheon (KR)

(73) Assignee: Hyundai Mobis Co., Ltd., Seoul (KR)

( * ) Notice: Subject to any disclaimer, the term of this patent is extended or adjusted under 35 U.S.C. 154(b) by 163 days.

(21) Appl. No.: 11/319,446

(22) Filed: Dec. 29, 2005

(65) Prior Publication Data

US 2007/0046037 A1 Mar. 1, 2007

(30) Foreign Application Priority Data

Aug. 26, 2005 (KR) ..... 10-2005-0078950

(51) Int. Cl.
*E05C 19/00* (2006.01)
*E05C 1/08* (2006.01)

(52) U.S. Cl. ..... 292/304; 292/137; 292/163; 292/332; 292/335; 292/DIG. 4

(58) Field of Classification Search ..... 292/137, 292/163, 304, DIG. 4, 332, 335
See application file for complete search history.

(56) References Cited

U.S. PATENT DOCUMENTS 4,880,266 A 11/1989 Hoffman et al.
5,090,751 A * 2/1992 Kobayashi ..... 292/71
5,558,026 A 9/1996 Seibert
6,814,384 B2 11/2004 Grafton

FOREIGN PATENT DOCUMENTS

KR 10-2004 0071043 8/2004

OTHER PUBLICATIONS

English language Abstract of Korean 10-2004-0071043.

* cited by examiner

*Primary Examiner*—Carlos Lugo
(74) *Attorney, Agent, or Firm*—Greenblum & Bernstein P.L.C.

(57) ABSTRACT

A tray latching device includes a latch including a hook panel to catch an end of a clasp panel that protrudes from a side of an automobile tray, a heart cam to release the clasp panel of the tray from the hook panel when a predetermined stroke is applied thereto by the clasp panel of the tray, and a plurality of supporting indentations each formed with a plurality of stepped supporting portions. The tray further includes a housing and a plurality of inertial sensors each including a supporting portion to be coupled to the housing via a shaft, and an extension that protrudes from the supporting portion to support an innermost supporting portion of one of the indentations of the latch.

2 Claims, 3 Drawing Sheets

TRAY LATCHING DEVICE

BACKGROUND OF THE INVENTION

1. Field of the Invention

The present invention relates to a tray latching device, and, more particularly, to a tray latching device for preventing an automobile tray, which is designed to be unlatched and opened when a predetermined stroke is applied thereto, from being unintentionally opened by an automobile collision, wherein a latch, which is formed with a plurality of supporting indentations having stepped supporting portions, is arranged at a side of the tray and a plurality of inertial sensors, which are adapted to rotate by collision inertia to suppress the stroke of the tray, is arranged at a side of the latch opposite to the tray, whereby, even in the case of rapid speed variation due to an automobile collision, unintentional opening of the tray can be prevented in accordance with operation of the inertial sensors.

2. Description of the Related Art

In general, an instrument panel of an automobile is provided with a dashboard in front of a driver's seat and a glove compartment in front of a passenger's seat. Between the driver's seat and the passenger's seat is provided a center-facia. The center-facia includes a switch to operate an audio system or air-conditioner.

The center-facia also includes a tray for holding cigarette ashes and butts or for receiving small-size articles, such as coins or credit cards. Admittedly, the tray may be mounted in other locations except for the center-facia.

In the case of the tray used to receive articles, it is important that the tray not be opened by a shock caused in an automobile collision since articles ejected from the opened tray may injure a driver or passenger. Thus, the tray must have a latch structure capable of preventing the tray from being unintentionally opened, for example, during a collision test or shock test. When a collision test is carried out, an automobile will suddenly experience a force approximately equal to thirty times of gravitational acceleration. Thus, the tray must be designed to endure such a rapid speed variation, to prevent unintentional opening thereof.

However, conventional trays tend to be easily opened even by a small automobile collision, and have the risk of injury to a driver or passenger due to articles ejected from the tray. In particular, a recent tendency to increase the size of the automobile tray causes the tray to be opened more easily since the tray is more affected by collision inertia. This has the problem of not only damage or loss of articles received in the tray, but also injury to a driver or passenger when articles ejected from the tray strike the driver or passenger.

SUMMARY OF THE INVENTION

Therefore, the present invention has been made in view of the above problems, and it is an object of the present invention to provide a tray latching device, which can prevent unintentional opening of an automobile tray that is used to hold cigarette ashes and butts or to receive small articles, even when a sudden shock is applied to the tray due to collision inertia in the event of an automobile collision, thereby preventing ejection of articles received in the tray and injury to a driver or passenger due to the articles ejected from the tray.

In accordance with an aspect of the present invention, the above and other objects can be accomplished by the provision of a tray latching device comprising: a latch including a hook panel to catch an end of a clasp panel that protrudes from a side of an automobile tray, a heart cam to release the clasp panel of the tray from the hook panel when a predetermined stroke is applied thereto by the clasp panel, and a plurality of supporting indentations each formed with a plurality of stepped supporting portions; a housing including a passage to allow the latch to move there through so that the hook panel of the latch catches the clasp panel of the tray, a fixture lever to move in one direction along the heart cam in accordance with the movement of the latch to be fixed in a restrictive dent of the heart cam and to be separated from the restrictive dent if a predetermined stroke is applied thereto, and a spring to be pressed by the latch; and a plurality of inertial sensors each including a supporting portion to be coupled to the housing via a shaft, and an extension that protrudes from the supporting portion to support an innermost portion of one of the indentations of the latch, the extension being adapted to rotate by collision inertia to suppress a stroke that causes unintentional separation of the fixture lever from the heart cam and adapted to be elastically returned simultaneously with the removal of the collision inertia.

The latch is formed with the plurality of indentations having the stepped supporting portions, which are vertically or horizontally arranged, and the plurality of inertial sensors are arranged at a side of the latch to face the indentations in a one to one ratio. This arrangement allows the tray to be supported by the plurality of inertial sensors over a wide area. Also, even when being rotated by collision inertia, the inertial sensors can support an outermost one of the stepped supporting portions of the indentations formed in the latch, respectively, without a risk of unintentional separation from the indentations.

In a latched state of the tray, collision inertia applied to the tray in the event of an automobile collision is supported by the extensions of the inertial sensors. In this case, since the rotational axis of each inertial sensor is eccentric relative to the extension thereof, the extensions of the inertial sensors are rotated to a front side of the latch opposite to the tray by rapid collision inertia. As a result, the inertial sensors are adapted to support an outermost stepped supporting portion of the respective indentations formed in the latch.

If a predetermined stroke is applied to the latch, the fixture lever is moved in a counterclockwise direction from the restrictive dent of the heart cam provided in the latch so that the latch is released from the tray. Thereby, The tray can be opened to an automobile passenger compartment.

Thus, even if the latch is pushed in an opposite direction of the tray by the collision inertia, the movement of the latch is interrupted by the extensions by virtue of rotation of the inertial sensors. This consequently restricts a stroke of the latch, and prevents the latch from being moved backward in the housing. Preventing backward movement of the latch has the effect of preventing the hook panel from being loosened, and thus, preventing the clasp panel of the tray from being released from the hook panel. Thus, there is no risk of unintentional opening of the tray due to a sudden automobile collision.

In the event of an automobile collision, the extension of a respective one of the inertial sensors is rotated by collision inertia about the shaft coupled to the housing. In this case, the supporting portion of the inertial sensor acts as a moment arm. In accordance with such a rotation of the extension, the supporting portion of the inertia sensor presses a spring, and an end of the extension supports the outermost stepped supporting portion of one of the indentations that are vertically arranged in the latch, thereby restricting a stroke of the latch.

Simultaneously with the removal of the collision inertia applied to the inertial sensor, the extension is pressed by the spring to be returned to its original position, thereby supporting the innermost of the stepped supporting portions of one of the indentations. In this way, restriction to the stroke of the latch by the inertial sensors is released. Thereby, the latch is able to attain a stroke to release the fixture lever from the restrictive dent of the heart cam if the tray is pressed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of a tray latching device according to the present invention will be described with reference to the accompanying drawings.

The following embodiment is not intended to limit the scope of the present invention, rather, it is given for exemplary purposes, and various modifications, additions and substitutions are possible via a technical idea of the present invention.

Figure 1:
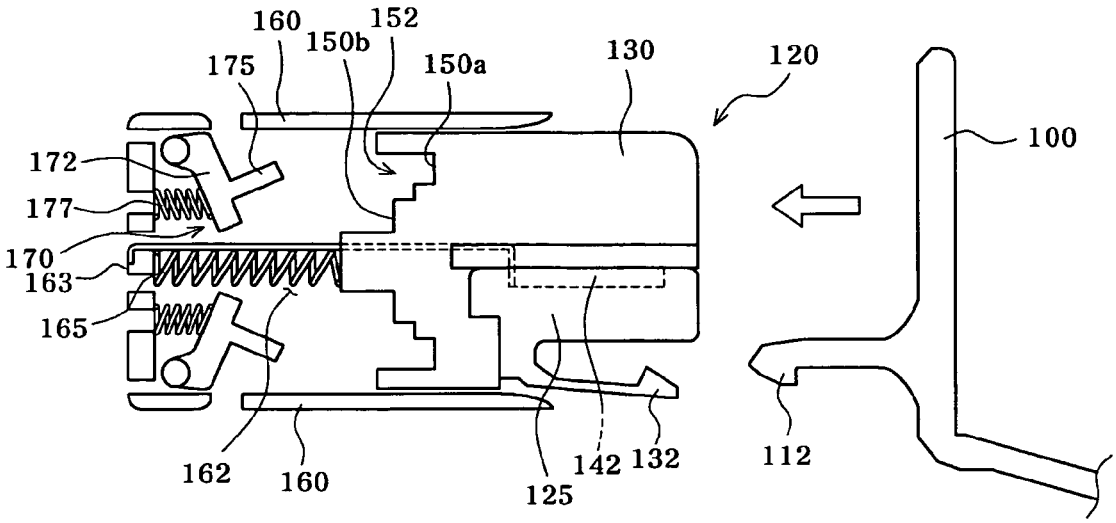
FIG. 1 is a side view illustrating an automobile tray latching device according to an embodiment of the present invention.
Figure 2:
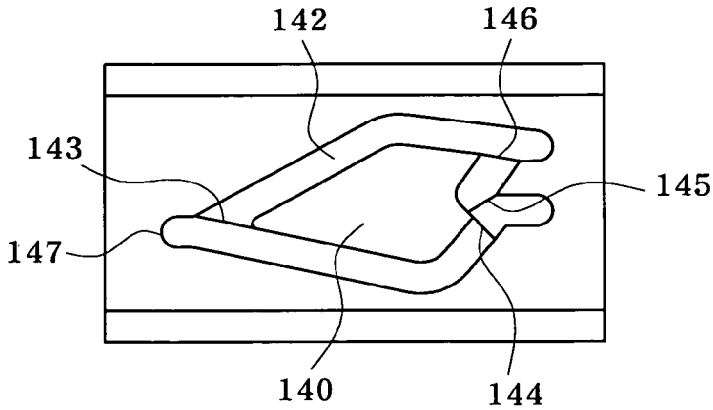
FIG. 2 is a plan view illustrating a heart cam included in the automobile tray latching device according to the embodiment of the present invention.
Figure 3:
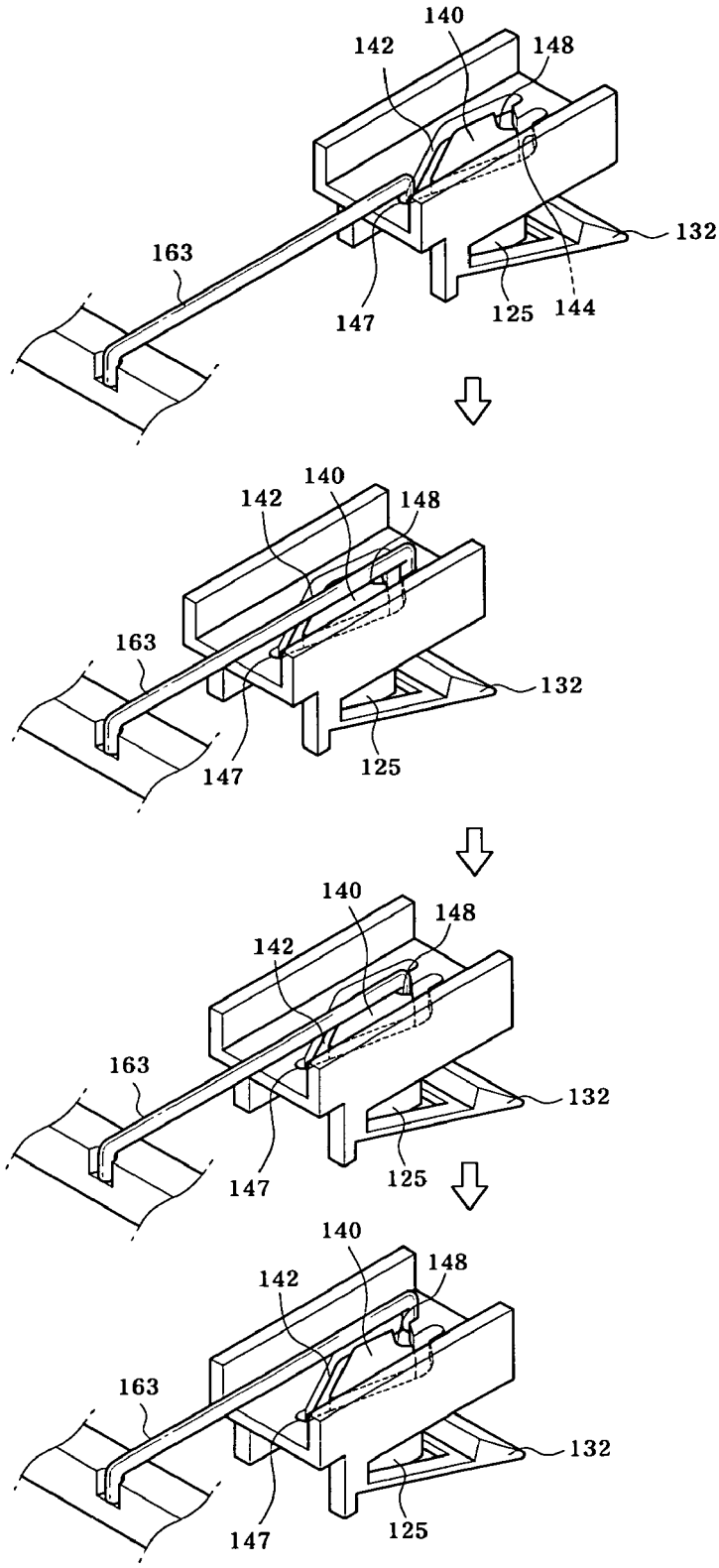
FIG. 3 is a perspective view illustrating the operation of a fixture lever in accordance with a movement of a latch relative to a housing included in the automobile tray latching device according to the embodiment of the present invention.

As shown in FIGS. 1 to 3, the tray latching device according to an embodiment of the present invention includes a latch 120 provided with a hook panel 132. The hook panel 132 catches the end of a clasp panel 112 that protrudes from a side of an automobile tray 100. The latch 120 is also provided therein with a heart cam 140. The heart cam 140 serves to release the clasp panel 112 of the tray 100 from the hook panel 132 when a predetermined stroke is applied to the clasp panel 112 via a pressure operation. Also, the latch 120 has a plurality of supporting indentations 152 each formed with a plurality of stepped supporting portions 150*a* and 150*b*.

The tray latching device further includes a housing 160 for the insertion of the latch 120. The housing 160 internally defines a passage 162 to allow the latch 120 to move therethrough, so that the clasp panel 112 of the tray 100 is caught by the hook panel 132. The housing 160 is provided with a fixture lever 163. The fixture lever 163 is operated in such a fashion that it moves in one direction along the heart cam 40 in accordance with the movement of the latch 120 to be fixed in a restrictive dent 148 of the heart cam 140, and is then separated from the restrictive dent 148 if a predetermined stroke is applied thereto. The housing 160 is also provided with a spring 165 that supports the latch 120 to be pressed by the latch 120.

The heart cam 140 is formed along the periphery thereof with a heart-shaped groove 142. As the latch 120 is moved forward through the passage 162 of the housing 160 in an opposite direction of the tray 100, an end of the fixture lever 163 is adapted to move in a counterclockwise direction along the heart-shaped groove 142 while coming into contact at a lower surface thereof with the bottom of the heart-shaped groove 142. Here, forward movement means that the latch 120 is moved in a leftward direction of FIG. 1. The groove 142 of the heart cam 140 is provided with a first raised portion 143 near the apex 147 to allow the end of the fixture lever 163 to move in the counterclockwise direction from a pointed apex 147 of the heart cam 140. Also, the groove 142 is provided with a second raised portion 144 near the restrictive dent 148 of the heart cam 140 to allow the end of the fixture lever 163 to be seated in the restrictive dent 148 when a maximum stroke is applied to the latch 120.

When the end of the fixture lever 163 is seated in the restrictive dent 148 of the heart cam 140, the latch 120 is moved forward into the housing 160 opposite to the tray 100 while pressing the spring 165 that supports the latch 120. In this case, the clasp panel 112 of the tray 100 is caught by the hook panel 132 of the latch 120, and the tray 100 is retracted into an instrument panel to be received therein.

Then, if a predetermined stroke is applied to the tray 100, the clasp panel 112 of the tray 110 presses the latch 120 to move the latch 120 forward, and the fixture lever 163 is separated from the restrictive dent 148 of the heart cam 140 to be moved in the counterclockwise direction along the heart cam 140.

In this case, to prevent the fixture lever 163 from moving in a clockwise direction from the restrictive dent 148, the groove 142 of the heart cam 140 is provided with a third raised portion 145 at a clockwise side of the restrictive dent 148. In addition, the groove 142 is provided with a fourth raised portion 146 near the restrictive dent 148, to prevent the fixture lever 163 from moving toward the third raised portion 145 in a clockwise direction beyond a maximum stroke point of the latch 120.

As the fixture lever 163 moves in the counterclockwise direction from the restrictive dent 148 to the apex 147 of the heart cam 140, the latch 120 is moved backward in the housing 160, and the clasp panel 112 of the tray 100 is released from the hook panel 132 of the latch 120. As a result the tray 100 protrudes outward from the instrument panel to be opened. Here, the backward movement of the latch 120 means that the latch 120 is moved in a rightward direction of FIG. 1

Figure 4:
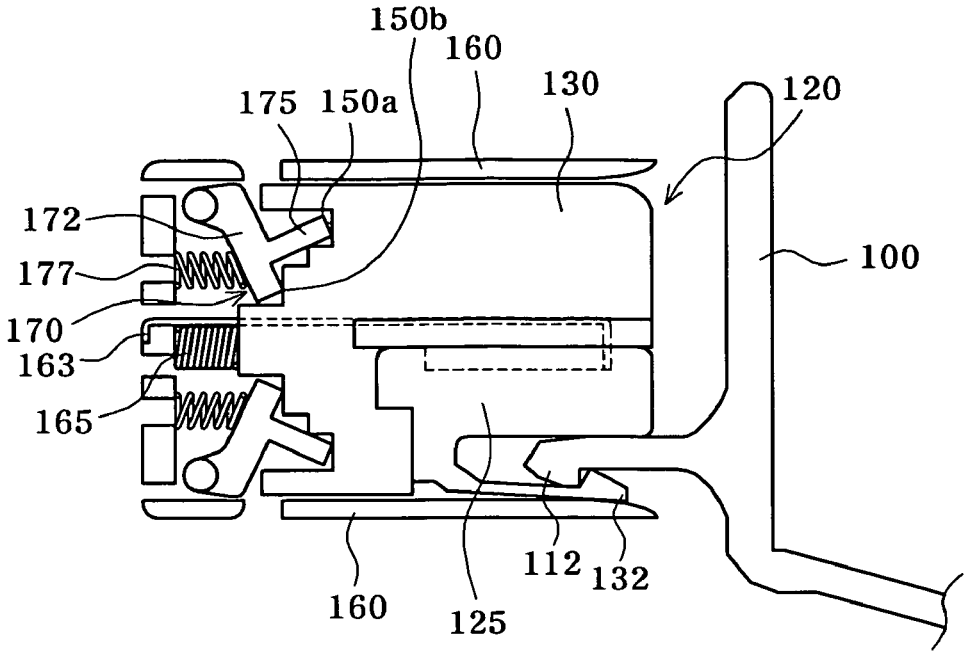
FIG. 4 is a side view illustrating a tray that is latched by the automobile tray latching device according to the embodiment of the present invention.
Figure 5:
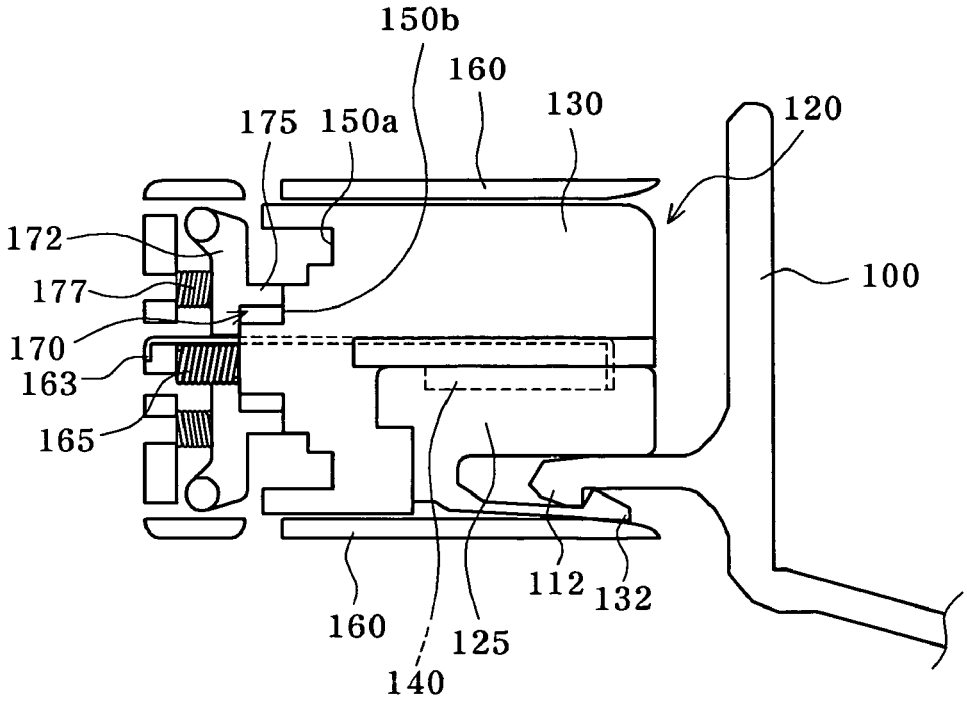
FIG. 5 is a side view illustrating a tray that is supported by inertial sensors of the automobile tray latching device according to the embodiment of the present invention so as not to be opened.

As shown in FIGS. 4 and 5, the tray latching device further includes a plurality of inertial sensors 170. The plurality of inertial sensors 170 are identical, and thus, the following description will be given in conjunction with only one inertial sensor. The inertial sensor 170 includes: a supporting portion 172 to be coupled to the housing 160 via a shaft; and an extension 175 that protrudes from the supporting portion 172 and is adapted to support the innermost portion of one of the indentations 152 of the latch 120. When the extension 175 is rotated by collision inertia in the event of an automobile collision, the extension 175 supports the outermost portion of the indentation 152. Simultaneously with the removal of the collision inertia, the inertial sensor 170 is elastically returned to the original position thereof, so that the extension 175 again supports the innermost portion of the indentation 152.

When the extension 175 of the inertial sensor 170 supports an outermost one of the stepped supporting portions, i.e. outermost stepped supporting portion 150*b* of the indentation 152, the extension 175 suppresses a forward movement stroke of the latch 120, preventing the fixture lever 163 from being separated from the restrictive dent 148 of the heart cam 140. That is, the inertial sensor 170 suppresses a stroke of the latch 120, thereby preventing the fixture lever 163 from being separated from the restrictive dent 148 of the heart cam 140, and consequently, preventing the clasp panel 112 of the tray 100 from being unintentionally released from the hook panel 132. In this way, the tray 100 can be stably maintained in a closed state.

In the present invention, the latch 120 is formed with the plurality of indentations 152 having the stepped supporting portions 150*a* and 150*b* that are arranged vertically, and the plurality of inertial sensors 170 are arranged at a side of the latch 120 to face the indentations 152 in a one to one ratio. This arrangement allows the tray 100 to be supported by the plurality of inertial sensors 170 over a wide area. Also, even when being rotated by collision inertia, the inertial sensor 170 can support the outermost stepped supporting portion 150*b* of the indentation 152 formed in the latch 120 without a risk of unintentional separation from the indentation 152.

Specifically, the latch 120 includes: a latching block 125 having a passage for the movement of the clasp panel 112 of the tray 100; and a pressure block 130 coupled to the latching block 125 in which a pair of the supporting indentations 152 is vertically arranged so that the stepped supporting portions 150*a* and 150*b* of both the supporting indentations 152 are symmetrical to each other. The extensions 175 of the inertial sensors 170 are positioned to face the supporting indentations 152 defined in the pressure block 130, respectively, so that they support the outermost stepped supporting portions 150*b* of the respective supporting indentations 152 when being rotated along the stepped supporting portions 150*a* and 150*b* by collision inertia in the event of an automobile collision.

With this configuration, collision inertia applied to the tray 100 in the event of an automobile collision is supported by the extensions 175 of the inertial sensors 170. In this case, since a rotational axis of the inertial sensor 170 is eccentric relative to the extension 175, the extension 175 of the inertial sensor 170 is rotated to a front side of the latch 120 opposite to the tray 100 by rapid collision inertia. As a result, the extension 175 of the inertial sensor 170 is adapted to support the outermost stepped supporting portion 150*b* of the indentation 152.

In the case of an automobile collision, the extension 175 is rotated by collision inertia about the shaft coupled to the housing 160. In this case, the supporting portion 172 acts as a moment arm. In accordance with such a rotation of the extension 175, the supporting portion 172 presses a spring 177, and an end of the extension 175 supports the outermost stepped supporting portion 150*b* of the indentation 152, thereby restricting a stroke of the latch 120.

Simultaneously with the removal of collision inertia applied to the inertial sensor 170, the extension 175 is pressed by the spring 177 to be returned to its original position, thereby supporting the innermost stepped supporting portion 150*a* of the indentation 152. That is, restriction to the stroke of the latch 120 by the inertial sensor 170 is released. Thereby, the latch 120 can attain a stroke to release the fixture lever 163 from the restrictive dent 148 of the heart cam 140 if the tray 100 is pressed.

As is apparent from the above description, the tray latching device of the present invention has the effect of preventing a tray from being unintentionally opened even if the shock of an automobile collision is applied thereto. Thereby, there is no risk of ejection of articles received in the tray due to a sudden opening of the tray. In particular, when the tray is used to hold cigarette ashes and butts or to receive small articles, since the tray latching device of the present invention can prevent the tray from being unintentionally opened by collision inertia, it is possible to eliminate the risk of injury to a driver or passenger due to the articles ejected from the tray.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A tray latching device comprising:

a latch including a hook panel to catch an end of a clasp panel that protrudes from a side of an automobile tray, a heart cam to release the clasp panel of the tray from the hook panel when a predetermined stroke is applied thereto by the clasp panel of the tray, and a plurality of supporting indentations each formed with a plurality of stepped supporting portions;

a housing including a passage to allow the latch to move therethrough so that the hook panel of the latch catches the clasp panel, a fixture lever to move in one direction along the heart cam in accordance with the movement of the latch to be fixed in a restrictive dent of the heart cam and to be separated from the restrictive dent if a predetermined stroke is applied thereto, and a spring to be pressed by the latch; and a plurality of inertial sensors each including a supporting portion to be coupled to the housing via a shaft, and an extension that protrudes from the supporting portion to support an innermost stepped supporting portion of one of the indentations of the latch, the extension configured to rotate by collision inertia to support an outermost stepped supporting portion of one of the indentations of the latch to suppress a stroke that causes unintentional separation of the fixture lever from the heart cam and configured to be elastically returned to support the innermost stepped supporting portion simultaneously with the removal of the collision inertia, wherein the innermost stepped supporting portion is a step provided in the indentation toward the tray, and an end of the extension is configured to contact the innermost stepped supporting portion upon removal of the collision inertia.

2. The tray latching device as set forth in claim 1, wherein the latch includes:

a latching block having a passage for the movement of the clasp panel of the tray; and a pressure block coupled to the latching block, in which a pair of the supporting indentations is vertically defined in a side region thereof so that the stepped supporting portions of both the supporting indentations are symmetrical to each other, wherein the extensions of the inertial sensors are positioned to face the supporting indentations defined in the pressure block, respectively, so that they support an outermost one of the stepped supporting portions of the respective supporting indentations when being rotated along the stepped supporting portions by collision inertia in the event of an automobile collision.

* * * * *